United States Patent [19]

Mochinski

[11] 3,938,286

[45] Feb. 17, 1976

[54] GRAVE MARKER

[76] Inventor: Frank N. Mochinski, 708 Adams St. NE., Minneapolis, Minn. 55413

[22] Filed: Dec. 18, 1974

[21] Appl. No.: 533,965

[52] U.S. Cl. ..... 52/103

[51] Int. Cl.[2] ..... E04H 13/00; E04F 19/02

[58] Field of Search ..... 52/102–105, 52/169, 315, 316

[56] References Cited

UNITED STATES PATENTS

| | | | |
|---|---|---|---|
| 683,305 | 9/1901 | Levin | 52/102 X |
| 1,916,494 | 7/1933 | Schrickel | 52/102 |
| 3,310,918 | 3/1967 | Taylor | 52/103 |
| 3,477,181 | 11/1969 | Robison | 52/103 |

*Primary Examiner*—J. Karl Bell

*Attorney, Agent, or Firm*—Williamson, Bains & Moore

[57] ABSTRACT

An improved grave marker comprises an integral molded body of plastic-like material having an upright member carrying identifying indicia and having a generally horizontal apron extending outwardly from the upright member, the apron being provided with a flat upper surface. The outer periphery of the apron has a downwardly angled earth-engaging ramp which is crenellated to define alternating crenels and merlons. The merlons are provided with root channels passing downwardly therethrough. When the apron is imbedded in the earth with the flat upper surface at ground level, the grass roots of sod overlying the ramp grow downwardly through the root channels of the merlons and also grow outwardly over the outer periphery of the ramp, on all sides of the merlons, to solidly anchor the marker to earth and resist tipping thereof. The flat upper surface of the apron, which is positioned at ground level, provides a runway along which a lawnmower may roll to trim the grass growing above the ramp adjacent the runway.

7 Claims, 5 Drawing Figures

GRAVE MARKER

BACKGROUND OF THE INVENTION

The invention relates to the field of tip-resistant grave markers and provides and easily produced, long lasting and inexpensive solution to vandalism and maintenance problems encountered by cemetery maintenance crews.

The long used, traditional stone monument is expensive and time consuming to manufacture, relatively easily broken when exposed to vandalism, and virtually unrepairable if cracked or chipped. Because of these shortcomings, a monument formed of easily shaped, colorable, inexpensive, and easily repairable material is much needed.

In recent years, the use of upright monuments has been discouraged by many cemetery associations because of high vulnerability to vandalism since they are easily tipped unless anchored by costly and time-consuming techniques. In addition, upright monuments produce increased maintenance costs to cemetery associations because grass adjacent such upright monuments must be hand trimmed and cannot be easily or neatly maintained by a standard lawnmower. Some cemetery associations have prohibited the use of upright monuments, requiring that markers be positioned flush with the ground level to eliminate this hand trimming around the markers. Because of substantial popularity of upright monuments, however, it is desirable that a grave marker structure be devised which is resistant to tipping by vandals and which produces little or no additional maintenance problems to lawn cutting crews.

In the past, the necessity for making upright monuments resistant to tipping has prompted designers to imbed such monuments in heavy concrete bases extending into the earth. Other designers have devised elaborate anchor structures which, unfortunately, are generally time consuming and expensive to install and are often but marginally effective. An improved grave marker is needed which is resistant to tipping but requires minimal time to install and does not require elaborate anchors or pre-poured concrete slabs for its integrity. In addition, the anchoring apparatus used with the markers should have no adverse impact on grass maintenance and should not inhibit healthy growth of the grass adjacent to the marker. The present invention provides a solution to these problems.

SUMMARY OF THE INVENTION

The improved grave marker invention has an integral body molded of long lasting, easily repairable and colorable plastic-like material and includes a generally upright member bearing identifying indicia representative of the decedent. The integral body includes a generally horizontal apron affixed to and extending outwardly from the upright member, the apron having upper and lower surfaces with a downwardly and outwardly inclined earth-engaging ramp interconnecting the surfaces and extending about the periphery of the apron.

The upper surface is mounted flush with ground level and defines a flat runway along which a lawnmower may roll to thereby cut the grass adjacent the apron and eliminate hand trimming about the monument. If desired, the apron may be formed of a green material to harmoniously blend with the lawn coloration.

The outer periphery of the ramp is crenellated with a plurality of alternating crenels and merlons thereabout. Root channels are provided in the merlons and extend between the ramp and the lower surface of the apron. With the described structure, grass growing above the ramp and adjacent the runway sends roots downwardly; when these roots encounter the ramp they tend to naturally grow downwardly along the ramp, passing through the crenels and root channels and wrapping themselves about the outer periphery of the apron to solidly anchor the apron to the earth. The upright body preferably extends below the lower surface of the apron and when imbedded in the earth cooperates with the apron to resist tipping of the grave marker. Accordingly, the invention provides an easily installed grave marker with substantial resistance to tipping, while requiring minimal maintenance.

These and other advantages of the present invention will be apparent from the following detailed specification and appended drawings.

DESCRIPTION OF THE PREFERRED EMBODIMENT

Figure 1:
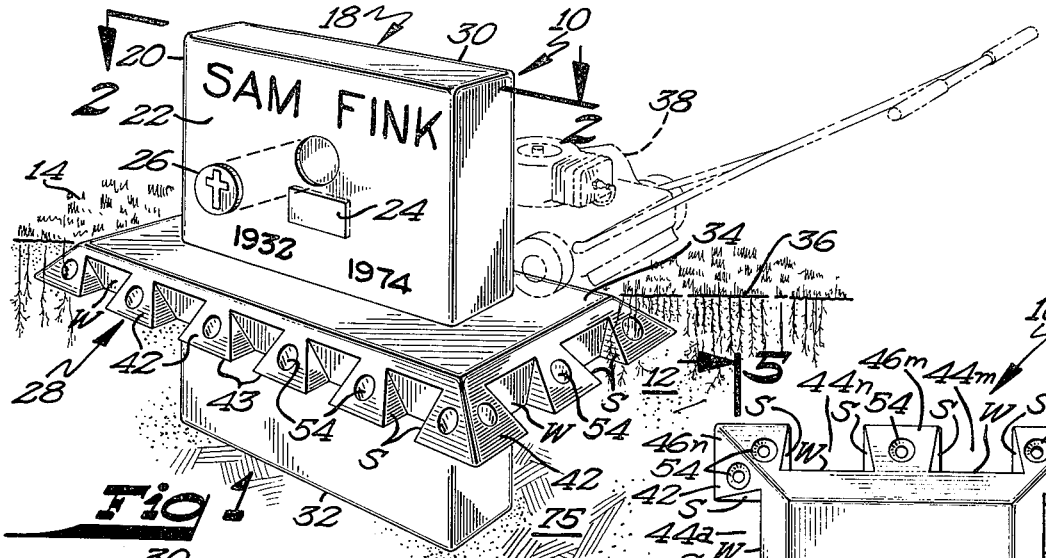
FIG. 1 is a perspective view of the invention showing it installed on a cemetery lawn.
Figure 3:
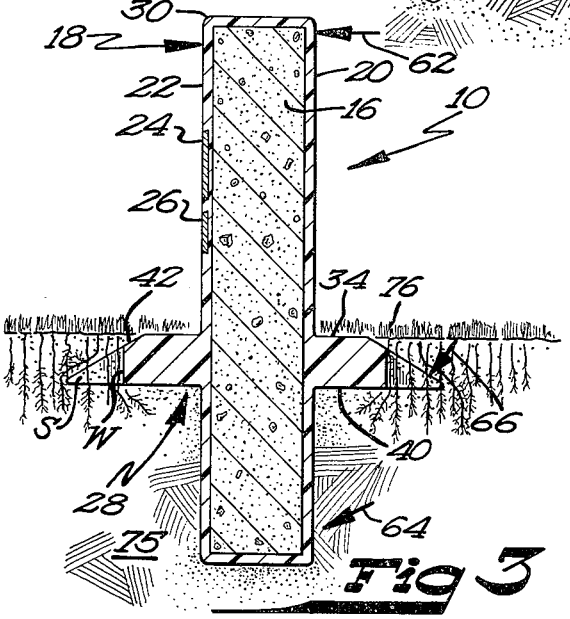
FIG. 3 is a cross-sectional view taken along the cutting plane 3—3 of FIG. 2.
Figure 2:
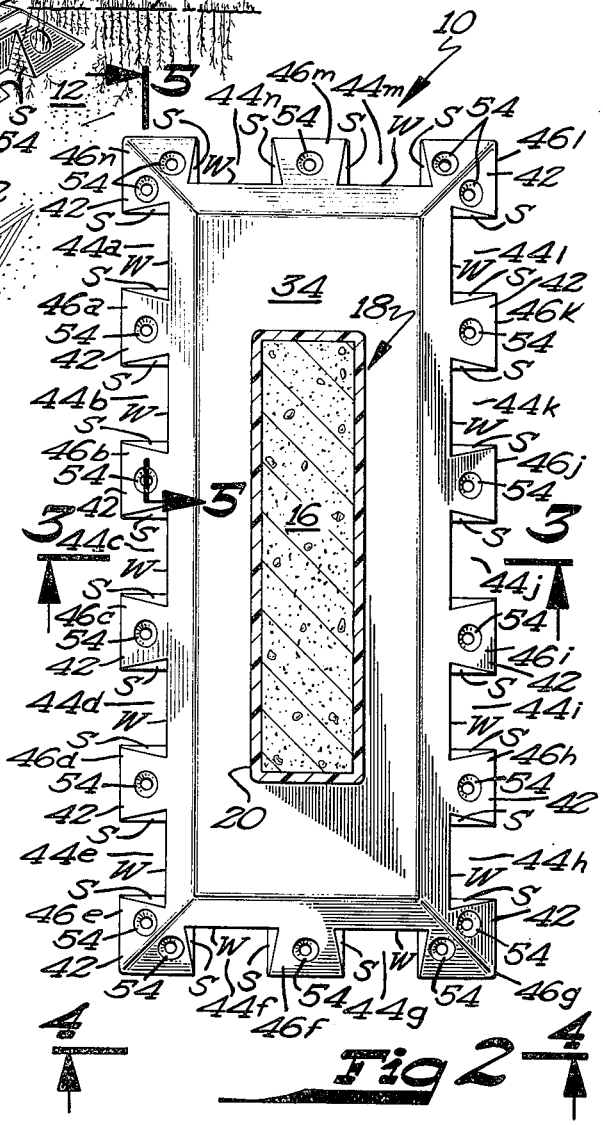
FIG. 2 is a top elevation view, partly in section, taken along the cutting plane 2—2 of FIG. 1.

Referring now to FIGS. 1–3, the improved grave marker 10 is shown mounted on a cemetery lawn 12 with the grass 14 closely surrounding the outer periphery of the marker 10. The marker may be formed as an integral body molded of plastic-like material, inter alia fiberglass, epoxy resin or the like, it being desirable that the material selected be easily molded, extremely long lasting, substantially impervious to the elements, easily colorable, and readily repairable.

The grave marker 10 includes a generally upright member 18 having a central core 16 formed of stone, sand, cement or the like to provide additional mass and weight, the core being surrounded by an outer shell 20 of molded, plastic-like material. The name and dates of birth and death of the decedent may be easily molded on the decorative exterior face 22 of the marker and these and other identifying indicia representative of the decedent may be molded or implanted on the face 22. If desired, a clear lucite block 24 containing a picture or memorabilia of the decedent or an emblem 26 representative of religious or fraternal organization affiliation of the decedent may be implanted.

The grave marker 10 has a generally horizontal apron 28 rigidly affixed to the upright member 18 which extends about the upright member and outwardly therefrom. The apron 28 is positioned between the top 30 and bottom 32 of upright member 18, preferably with the bottom 32 being positioned substantially below the apron 28 to provide additional stability and resistance to tipping of the marker by lowering the center of gravity of the upright member 18.

The apron 28 has a generally flat upper surface 34 adjacent the upright member 18 and positioned at ground level 36 to provide a runway along which the wheel of lawnmower 38 may be driven during cutting of the grass adjacent the marker, thereby permitting the grass at the edges of the marker to be cut without hand trimming. If desired, the apron 28 may be formed of a green plastic material matching the color of the adjacent grass so as to have the apron blend harmoniously with the lawn. The lower surface 40 of the apron 28 (FIG. 3) is preferably flat and horizontal in order that the marker may more readily be installed in the ground 75 at a prepared excavation with minimal tamping and earth movement.

An earth-engaging ramp 42 extends about the apron 28 and interconnects the upper and lower surfaces 34 and 40, respectfully, the ramp 42 being spaced outwardly from the upright member 18 and inclined outwardly and downwardly from the upper surface 34 to the lower surface 40 to define the outer periphery of the apron 28. The ramp 42 is positioned below ground level 36 when the grave marker is installed and is of substantial assistance in making the marker resistant to tipping and in assuring survival of the grass 76 immediately above the ramp (FIG. 3). As roots 60 from the grass 76 grow downwardly and encounter the ramp 42, the roots naturally follow the starting ramp in the downward direction, being guided by the ramp surface to deeper, more moist ground, thereby encouraging the root system to move into ground better able to provide needed moisture. As the roots pass over the outer edge 43 of the ramp, the roots tend to spread and thereby anchor the ramp to the earth. Accordingly, the downwardly angled ramp 42 receives and directs roots of the grass 76 growing above the ramp outwardly and downwardly along the ramp and clear of the ramp, so that grass growing above the ramp can wrap its roots about the outer periphery of the apron 28 to further anchor the apron to the ground 75 while simultaneously directing the roots toward deeper, more moist ground for improved grass sustenance.

Additional anchoring can be obtained by shaping the ramp 42 so as to have it crenellated with alternating crenels **44*a* through 44*n* and merlons 46*a* through 46*n* extending about the outer periphery of the apron 28. The crenels may be of larger or smaller size than those shown in the drawings, and a greater or lesser number provided. The alternating crenels and merlons permit the grass 76 above the merlons to pass its roots downwardly through the crenels and become solidly anchored in the earth 75. The crenellated outer periphery increases the effective length of the outer periphery of the apron 28 and accordingly increases the distance along which the apron is rigidly anchored to the earth 75 by the grass roots of the lawn, thus providing increased holding power and further resisting tipping of the marker 10. With the crenellated apron 28 as shown in FIG. 2**, the merlons are, in effect, a plurality of snovel-like blades projected outwardly under the sod surrounding the marker and thus strongly resisting extraction or tipping of the marker.

Figure 4:
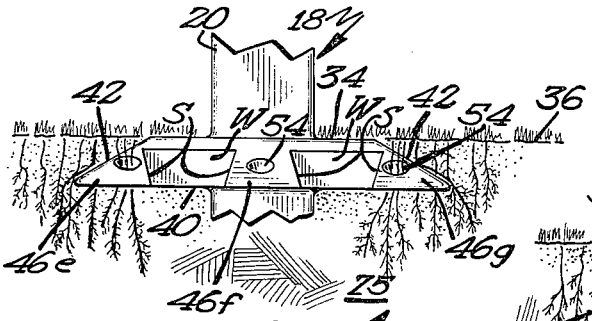
FIG. 4 is an end elevation view of the apron of the marker shown in FIG. 2, taken in the direction of cutting plane 4—4.

The effectiveness of the crenellated ramp can be further increased by inclining the sidewalls S of adjacent merlons as is illustrated by adjacent merlons **46*e* and 46*f* in FIG. 4. While only the sidewalls S of the merlons 46*e* and 46*f* will be described in detail, it should be understood that any number of the merlons may have their sidewalls so inclined and preferably all of the merlons are formed with identical inclined sidewalls, as shown in FIGS. 1 and 2. The sidewalls S (FIG. 4) are inclined such that the spacing between the sidewalls of each merlon is greater at the lower surface 40 than at the ramp 42 to thereby receive a greater number of roots from grass overlying the merlons and direct the roots through the crenels to produce a stronger holding effect due to the additional roots passing through the crenels and anchoring themselves below the level of the lower surface 40**. The sidewalls S of adjacent merlons are interconnected by generally vertically inclined inner walls W.

To further anchor the marker 10, some or all of the merlons may be provided with root channels 54 which extend from the ramp 42 downwardly to the lower surface 40 of the apron 28. Preferably, the root channels 54 are provided with a larger orifice 55 on the ramp and a smaller orifice 57 on the lower surface 40, the root channel tapering inwardly from orifice 55 to 57. This structure has the desirable effect of gathering downward moving moisture and directing it through the root channel to a location below the merlons. Any grass roots encountering the root channel will tend to follow the root channel and the moisture, causing the roots to pass through the root channels and lodge in the earth beneath the merlons to further hold the apron 28 to the earth. In addition, by encouraging the roots to move downwardly through the merlons rather than to remain on the upper surface of the merlon, the sod above the merlon has a further increased chance of survival in the hot summer months when deep roots are of importance to provide needed moisture to the grass.

Figure 5:
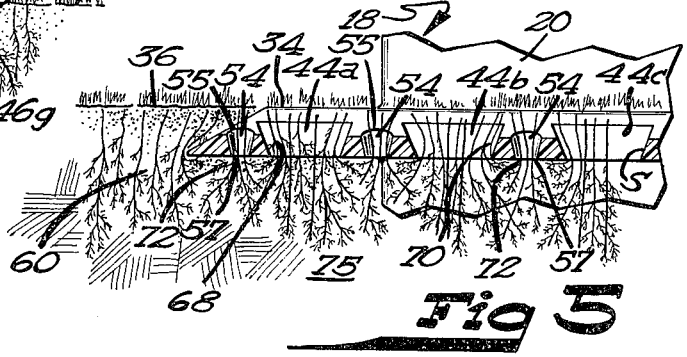
FIG. 5 is a partial cross-sectional front view taken along the cutting plane 5—5 in FIG. 2 and showing the apron embedded in the earth below ground level.

In operation, the grave marker 10 is installed at a grave site with the upper surface or runway 34 being mounted substantially at ground level 36 with the bottom 32 of the marker well below ground level in a pre-formed excavation. The excavation is then filled in, placing a layer of sod about the edge of the grave marker, with sod overlying and covering the ramp 42, as best shown in FIG. 5, but not extending onto the runway 34. As the sod takes root about the grave marker, the grass roots 60 grow downwardly toward the ramp 42 and on encountering the ramp naturally tend to grow in a downwardly angled direction, following the ramp toward its edge 43 and moving downwardly below lower surface 40. As the roots 60 continue to grow and mature, they spread outwardly and under the apron 28 solidly anchoring the apron to the ground.

Referring now to FIG. 5, roots 68 and 70 encountering the angled sidewalls S of the merlons **46*n* and 46*a* naturally continue their downward growth, resulting in the roots passing through the crenel 44*a* and spreading outwardly into the ground below the apron 28. The root behavior just described for the crenel 44*a* is typical of root growth through all of the crenels of the apron 28**.

Roots 72 contacting and entering the upper orifice 55 of any root channel 54 (FIG. 5) are directed downwardly through the root channel and out of the lower orifice 57. Similarly, water accumulations caused by rainfall or sprinkling are caught by the root channels and directed downwardly, resulting in stimulated root growth and spreading of the roots beneath the merlons to provide additional anchorage for the grave marker 10. The combination of crenels and root channels is of substantial value in channeling rain water to the earth situated beneath the apron 28 to substantially encourage root formation and spreading beneath the apron.

Because the bottom 32 of the upright member 18 extends substantially below the apron 28, the downwardly extending member 18 and outwardly extending apron 28 cooperate to resist tipping of the marker. Accordingly, when a tipping force 62 is applied adjacent the top 30 of the member 18, the earth exerts reaction force 64 at the bottom of the upright member 18 and reaction force 66 on the top of the ramp 42, the reaction forces being of sufficient magnitude to be very effective in resisting tipping of the grave marker 10.

If the grave marker is scratched, tipped or broken by vandalism, its plastic-like material may be easily and quickly repaired at the grave site.

Accordingly, the invention provides a substantially improved grave marker which is highly resistant to tipping, extremely long lasting, easily repaired and relatively inexpensive.

What is claimed is:

1. An improved grave marker, resistant to tipping and usable on a cemetery lawn to permit easier trimming of grass adjacent the marker by a standard lawnmower having wheels at ground level, comprising:

an integral body including a generally upright member with a top and bottom and having a decorative exterior bearing identifying indicia;

said integral body further including a generally horizontal apron affixed to and extending about said upright member, extending outwardly therefrom, and positioned between said top and bottom of said member, said apron including upper and lower surfaces with said upper surface defining a substantially flat runway adjacent said upright member and positionable at substantially ground level to permit a wheel of the lawnmower to roll on said flat runway, thereby trimming grass adjacent said apron, said bottom of said upright member being positionable below ground level and cooperating with the outwardly extending apron to resist tipping of the marker;

said apron further including an earth-engaging ramp extending about said apron and positioned between said upper and lower surfaces of said apron and spaced outwardly from said upright member to define the outer periphery of said apron, said ramp being inclined outwardly and downwardly from said upper surface toward said lower surface and positionable below ground level to receive and direct roots of grass growing above said ramp outwardly and downwardly along said ramp and clear of said ramp so grass growing above said ramp will wrap its roots about said outer periphery of said apron to anchor said apron to the ground and to direct the roots toward deeper, more moist ground for improved grass sustenance; and said outer periphery of said apron being crenellated to provide a plurality of alternating crenels and merlons permitting grass above said merlons to send roots through said crenels to further anchor said ramp to the ground and further improve grass sustenance.

2. The improved grave marker of claim 1 wherein a plurality of said merlons have root channels extending downwardly from said ramp to said lower surface of said apron to provide a downward path for roots of grass growing above said merlons in order to thereby further anchor the apron to the ground.

3. The improved grave marker of claim 2 wherein each of said root channels is tapered with a larger orifice at said ramp than at said lower surface to thereby receive and direct an increased quantity of grass roots downwardly through each said root channel.

4. The improved grave marker of claim 1 wherein each of said merlons includes a pair of sidewalls extending between said ramp and said lower surface, said sidewalls being downwardly inclined from said ramp to said lower surface with the spacing between said sidewalls of each merlon being greater at said lower surface than at said ramp to thereby receive grass roots overlying said merlons and direct the roots through said crenels to encourage the roots to grow downwardly through said crenels to further anchor said ramp to the ground.

5. An improved grave marker resistant to tipping and usable on a grassy cemetery lawn, comprising:

a generally upright member having a decorative exterior;

a generally horizontal apron affixed to and extending about said upright member and extending outwardly therefrom;

said apron including an earth-engaging ramp mountable beneath the lawn and extending about said apron and defining the outer periphery of said apron, said ramp being inclined outwardly and downwardly for receiving and directing roots of grass growing about said ramp in an outward and downward direction along said ramp and clear of said ramp so grass growing above said outer periphery of said apron will wrap its roots about said outer periphery to anchor said apron to the ground; and said outer periphery being crenellated to provide a plurality of alternating crenels and merlons, permitting grass above said merlons to send roots through said crenels to further anchor said ramp to the ground.

6. An improved grave marker, resistant to tipping and usable on a cemetery lawn to permit easier trimming of the grass adjacent the marker by a standard lawnmower having wheels at ground level comprising:

an integral body molded of plastic-like material and including a generally upright member with a top and bottom and having a decorative exterior bearing identifying indicia;

said integral body further including a generally horizontal apron affixed to and extending about said upright member and extending outwardly therefrom, and positioned between said top and bottom of said member, said apron including upper and lower surfaces with said upper surface defining a substantially flat, generally horizontal runway adjacent said upright member and positionable at substantially ground level to permit a wheel of the lawnmower to roll on said flat runway thereby trimming grass adjacent said apron, said bottom of said upright member being positionable below ground level and cooperating with the outwardly extending apron to resist tipping of the marker; and said apron including an earth-engaging ramp extending about said apron and positioned between said upper and lower surfaces of said apron, communicating with said runway and spaced outwardly from said upright member to define the outer periphery of said apron, said ramp being inclined outwardly and downwardly and positionable below ground level to receive and direct roots of grass growing above said ramp outwardly and downwardly along said ramp and clear of said ramp so that grass growing above said ramp will wrap its roots about said outer periphery of said apron to anchor said apron to the ground and to direct the roots toward deeper, more moist ground for improved grass sustenance.

7. The improved grave marker of claim 6 wherein a plurality of said merlons have root channels extending downwardly from said ramp through said apron to provide a downward path for roots of grass growing above said merlons in order to thereby further anchor the ramp to the ground.

* * * * *